US007633470B2

(12) United States Patent
Kane

(10) Patent No.: US 7,633,470 B2
(45) Date of Patent: Dec. 15, 2009

(54) DRIVER CIRCUIT, AS FOR AN OLED DISPLAY

(76) Inventor: Michael Gillis Kane, 44 Robin Dr., Skillman, NJ (US) 08558

( * ) Notice: Subject to any disclaimer, the term of this patent is extended or adjusted under 35 U.S.C. 154(b) by 722 days.

(21) Appl. No.: 10/926,521

(22) Filed: Aug. 26, 2004

(65) Prior Publication Data

US 2005/0068275 A1 Mar. 31, 2005

Related U.S. Application Data

(60) Provisional application No. 60/507,060, filed on Sep. 29, 2003.

(51) Int. Cl.
*G09G 3/32* (2006.01)
*G09G 3/30* (2006.01)

(52) U.S. Cl. ..... 345/82; 345/76; 315/169.3

(58) Field of Classification Search ..... 345/36, 345/39, 44–46, 76–83; 315/169.3; 313/463
See application file for complete search history.

(56) References Cited

U.S. PATENT DOCUMENTS

| | | | |
|---|---|---|---|
| 3,590,156 | A | 6/1971 | Easton |
| 3,761,617 | A | 9/1973 | Tsuchiya et al. |
| 4,006,383 | A | 2/1977 | Luo et al. |
| 4,114,070 | A | 9/1978 | Asars |
| 4,528,480 | A | 7/1985 | Unagami et al. |
| 4,532,506 | A | 7/1985 | Kitazima et al. |
| 4,554,539 | A | 11/1985 | Graves |
| 4,652,872 | A | 3/1987 | Fujita |
| 4,736,137 | A | 4/1988 | Ohwada et al. |
| 4,797,667 | A | 1/1989 | Dolinar et al. |
| 4,958,105 | A | 9/1990 | Young et al. |
| 4,962,374 | A | 10/1990 | Fujioka et al. |
| 4,963,861 | A | 10/1990 | Thioulouse et al. |
| 4,975,691 | A | 12/1990 | Lee |
| 5,003,302 | A | 3/1991 | Richard et al. |
| 5,028,916 | A | 7/1991 | Ichikawa et al. |
| 5,063,378 | A | 11/1991 | Roach |
| 5,079,483 | A | 1/1992 | Sato |
| 5,095,248 | A | 3/1992 | Sato |
| 5,172,032 | A | 12/1992 | Alessio |
| 5,218,464 | A | 6/1993 | Hiroki et al. |
| 5,302,966 | A | 4/1994 | Stewart |
| 5,463,279 | A | 10/1995 | Khormaei |
| 5,670,979 | A | 9/1997 | Huq et al. |
| 5,684,365 | A | 11/1997 | Tang et al. |
| 5,723,950 | A | 3/1998 | Wei et al. |
| 5,903,246 | A | 5/1999 | Dingwall |
| 5,952,789 | A | 9/1999 | Stewart et al. |
| 5,959,599 | A | 9/1999 | Hirakata |
| 6,229,506 | B1 | 5/2001 | Dawson et al. |
| 6,229,508 | B1 | 5/2001 | Kane |
| 6,433,488 | B1 * | 8/2002 | Bu ..... 315/169.3 |

(Continued)

FOREIGN PATENT DOCUMENTS

| | | |
|---|---|---|
| EP | 0 653 741 | 5/1995 |

(Continued)

OTHER PUBLICATIONS

T. Sasaoka et al, "24.4L: Late-News Paper: A 13.0-inch AM-OLED Display with Top Emitting Structure and Adaptive Current Mode programmed Pixel Circuit (TAC)," SID 01 Digest, 2001, pp. 384-387.

(Continued)

*Primary Examiner*—Jimmy H Nguyen

(57) ABSTRACT

An electronic driver circuit for driving a load exhibiting a capacitance comprises a controllable current source for providing at an output current related to an input data signal and a capacitance coupled between the output and input of the controllable current source for providing positive feedback.

39 Claims, 2 Drawing Sheets

U.S. PATENT DOCUMENTS

| | | | | |
|---|---|---|---|---|
| 6,501,466 | B1 | 12/2002 | Yamagishi et al. | |
| 6,542,142 | B2 | 4/2003 | Yumoto et al. | |
| 6,583,775 | B1 | 6/2003 | Sekiya et al. | |
| 6,618,030 | B2 | 9/2003 | Kane et al. | |
| 6,686,699 | B2 | 2/2004 | Yumoto | |
| 6,697,057 | B2 * | 2/2004 | Koyama et al. | 345/204 |
| 6,750,833 | B2 | 6/2004 | Kasai | |
| 6,897,838 | B2 | 5/2005 | Okamoto | |
| 2002/0196211 | A1 | 12/2002 | Yumoto | |
| 2003/0107560 | A1 | 6/2003 | Yumoto et al. | |
| 2003/0128200 | A1 | 7/2003 | Yumoto | |
| 2004/0095297 | A1 * | 5/2004 | Libsch et al. | 345/76 |

FOREIGN PATENT DOCUMENTS

| | | |
|---|---|---|
| EP | 0 731 444 | 9/1996 |
| EP | 0 755 042 | 1/1997 |
| EP | 0 778 556 | 6/1997 |
| EP | 1 130 565 | 9/2001 |
| GB | 2 106 299 | 4/1983 |

OTHER PUBLICATIONS

Yi He et al, "Current-Source a -Si:H Thin-Film Transistor Circuit for Active-Matrix Organic Light-Emitting Displays," IEEE Electron Device Letters, vol. 21, No. 12, Dec. 2000, pp. 590-592.

James L. Sanford et al, "4.2: TFT AMOLED Pixel Circuits and Driving Methods," SID 03 Digest, 2003, pp. 10-13.

D. Fish et al, "32.1: Invited Paper: A Comparison of Pixel Circuits for Active Matrix Polymer/Organic LED Displays," SID 02 Digest, 2002, pp. 968-971.

Masuyuki Ohta et al, "9.4: A Novel Current programmed Pixel for Active Matrix OLED Displays," SID 03 Digest, 2003, pp. 108-111.

R.M.A. Dawson et al, "The Impact of the Transient Response of Organic Light Emitting Diodes on the Design of Active Matrix OLED Displays," IEEE International Electronic Device Meeting 1998, pp. 875-878.

Jae-Hoon Lee et al, P-71:OLED Pixel Design Employing a Novel Current Scaling Scheme, SID 03 Digest, 2003, pp. 490-493.

W.K. Kwak et al, "9.2: A 5.0-in WVGA AMOLED Display for PDAs," SID 03 Digest, pp. 100-103.

Hiroshi Kageyama et al, "9.1: A 3.5-inch OLED Display using a 4-TFT Pixel Circuit with an Innovative Pixel Driving Scheme," SID 03 Digest, 2003, pp. 96-99.

R. Dawson et al, "Amorphous Silicon Active Matrix Organic Light Emitting Diode (AMOLED) Displays Preliminary Program Report," Final Version, Oct. 31, 1998, 17 Pages.

A. Nathan et al, "Amorphous Silicon Back-Plane Electronics for OLED Displays," IEEE Journal Of Selected Topics In Quantum Electronics, vol. 10, No. 1, Jan./Feb. 2004, pp. 58-69.

* cited by examiner

DRIVER CIRCUIT, AS FOR AN OLED DISPLAY

This Application claims the benefit of U.S. Provisional Application Ser. No. 60/507,060 filed Sep. 29, 2003.

The present invention relates to an electronic circuit, and in particular to an electronic circuit for providing an electrical signal to a load.

"Driver circuit" is a term generally used to refer to an electronic circuit that provides an electrical signal, often referred to as "drive," to another circuit or device, which may be referred to as a load. The "drive" may be from a driving source that approximates a voltage source (e.g., a relatively low impedance source) or may be from a driving source that approximates a current source (e.g., a relatively high impedance source), or may be from a source having a finite, non-zero impedance. Transistors in certain configurations may exhibit a relatively high output impedance and so tend to approximate a current source.

Among the many different types of typical loads are displays comprising a plurality of display elements or picture elements. The elements of a high resolution display are typically arranged in rows and columns of a display that is driven via row lines and column lines. Row lines are electrical conductors connecting to picture elements in a given row and column lines are electrical conductors connecting to picture elements in a given column. Each element is addressed and energized responsive to signals selectively applied to the row and column lines, which sometimes may be referred to as select lines and data lines, respectively. Each element is selectively actuated or energized by the electrical signals applied to the row and column lines, and is typically a light-emitting element or a light transmissive element or a light reflecting element. Applying electrical signals to a given row line and a given column line activates or energizes the light-emitting element at the intersection thereof.

Among typical displays are organic light-emitting diode (OLED) displays. All passive-matrix organic light-emitting diode (PMOLED) displays known to the inventor and some active-matrix OLED (AMOLED) displays employ current-drive on the data lines, but current drive from a fixed current source is slow to charge the large capacitance associated with the data line, and this slowness limits the resolution that may be obtained from such display.

In OLED displays: the column data line typically has a large capacitance, e.g., a few nanofarads (nF) for PMOLED displays, due to the overlap of the column line conductor with many row line conductors, with only a thin (~100 nm) organic film separating them at each intersection. Large capacitances are very slow to charge when driven from a current source. In particular, if a current source is sourcing a current I into a capacitance C, then the time t required to charge the capacitance through a voltage swing $\Delta V$ is directly proportional to the product of the capacitance and the voltage change, divided by the charging current. As OLED efficiencies improve thereby reducing the required level of drive current, and/or if external capacitance from connectors is added, the slow-charging problem becomes worse.

Accordingly, there is a need for an electronic circuit suitable for driving a load having a capacitance associated therewith.

To this end, an electronic driver circuit may comprise a controllable current source for providing at an output current related to an input data signal and a capacitance coupled between the output and input of the controllable current source for providing positive feedback.

BRIEF DESCRIPTION OF THE DRAWING

The detailed description of the preferred embodiment(s) will be more easily and better understood when read in conjunction with the FIGURES of the Drawing which include.

Figure 1:
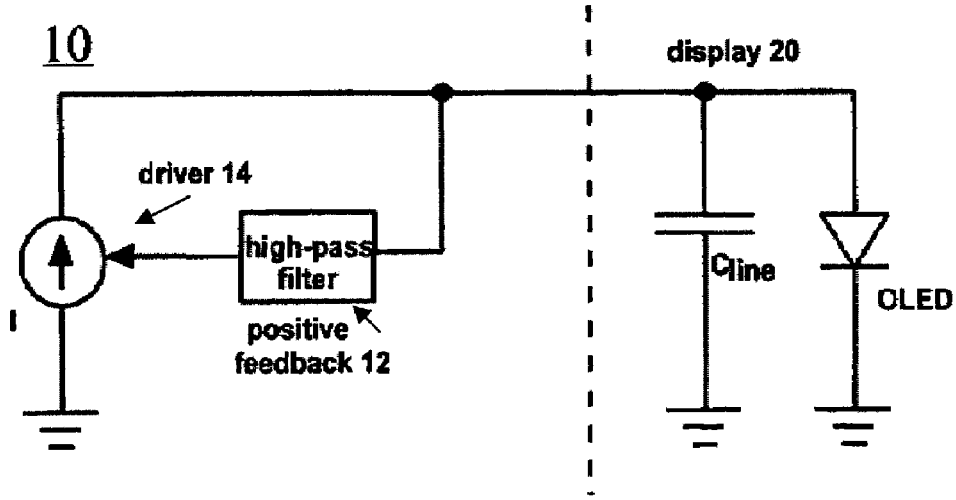
FIG. 1 is an electrical circuit schematic diagram of an example embodiment of an electronic driver circuit.

In the Drawing, where an element or feature is shown in more than one drawing figure, the same alphanumeric designation may be used to designate such element or feature in each figure, and where a closely related or modified element is shown in a figure, the same alphanumerical designation primed or designated "a" or "b" or the like may be used to designate the modified element or feature. Similarly, similar elements or features may be designated by like alphanumeric designations in different figures of the Drawing. It is noted that, according to common practice, the various features of the drawing are not to scale, and the dimensions of the various features are arbitrarily expanded or reduced for clarity, and any value stated in any Figure is given by way of example only.

DESCRIPTION OF THE PREFERRED EMBODIMENT(S)

FIG. 1 is an electrical circuit schematic diagram of an example embodiment of an electronic driver circuit 10. Display 20 typically involves a large number of picture elements arranged in rows and columns and connected to electrical row and column conductors via which energizing electrical signals are applied thereto. Display 20 is represented by a capacitance $C_{line}$ in parallel with a picture element, e.g., represented by the picture element OLED. The capacitance $C_{line}$ represents the effective aggregate capacitance of the display including capacitance inherent in the elements OLED and in the electrical conductors between the driver 10 and the picture element(s) OLED, whether resulting from the display or from wiring or other sources.

A circuit 10 employing feedback 12 from the column voltage to the controllable current source 14 that generates programming currents I for the pixels of a display 20 is illustrated. The output of the current source 14 is fed to the display 20, but is also applied to the input of a high-pass filter 12 that provides positive feedback to the current source 14. As the line capacitance $C_{line}$ of display 20 is being charged, e.g., to a more positive voltage, the high-pass filter 12 feeds back a positive voltage $V_o$ to the current source 14 that causes more current I to be generated, and the line capacitance $C_{line}$ charges even faster. As the OLED picture element OLED begins to turn on and the charging slows down as a result, then the magnitude of the fedback voltage drops. If the transfer function of the high-pass filter 12 is zero at DC, then the column voltage $V_o$ will settle at exactly the same voltage that it would have settled to in the absence of the feedback, and so the effect of the feedback is simply to make convergence to the final voltage $V_o$ value faster.

Figure 2:
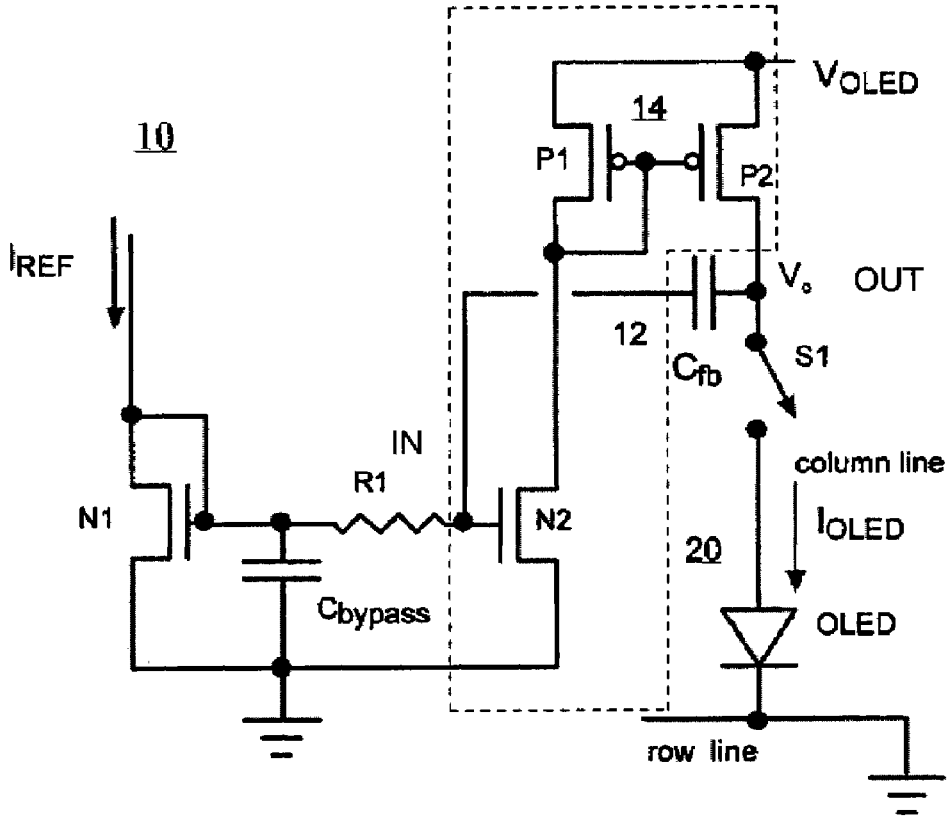
FIG. 2 is an electrical circuit schematic diagram of an example embodiment of an electronic driver circuit.

FIG. 2 is an electrical circuit schematic diagram of an example embodiment of an electronic driver circuit 10 that provides feedback 12 from the column voltage $V_o$ to the current generator 14 itself.

In particular, FIG. 2 illustrates a simple approach that requires little circuitry in addition to the current source 14 itself. The controllable current source 14 for the output is implemented as a PMOS current mirror P1, P2 attached to the high-voltage $V_{OLED}$ positive supply rail, driven by an NMOS current mirror N1, N2 which is referenced to ground. Switch S1 connects the current source to the column line of display 20 to begin charging thereof and the driving of the picture element OLED associated therewith. Switch S1 represents a commutating switch that connects the current source output $V_o$ to each column conductor in turn as the display 20 is scanned to produce a displayed pattern or image, however, only one column element OLED is shown.

In a current mirror circuit, such as that provided by diode-connected NMOS transistor N1 and NMOS transistor N2, or by diode-connected PMOS transistor P1 and PMOS transistor P2, the output current that flows in the output transistor N2, P2 is a multiple of the current supplied to transistor N1, P1, wherein the multiplier is determined principally by the physical characteristics of the transistors, as is known to those of ordinary skill in the art. The multiplier or ratio of a current mirror may be unity, or may be greater or less than unity.

A current mirror may have plural output transistors, e.g., transistors N2, P2, with their gates connected in parallel to a diode-connected input transistor, e.g., N1, P1, in which case each output transistor produces a current that is a multiple of the current applied to the input transistor, wherein the multiple or ratio is determined by the physical characteristics of each output transistor in relation to that of the input transistor. In other words, the multiplier or ratio of each output transistor of a plural output transistor current mirror may be unity, or may be greater or less than unity, independently of the other output transistors thereof.

Thus, in a driver circuit 10, one diode-connected transistor N1 may receive the input current $I_{REF}$ to produce a voltage that is applied to the gates of plural transistors N2 wherein each transistor N2 is associated with a driver (P1, P2, R1, $C_{fb}$) for a particular column of display 10. In such case, switch S1 is simply an on-off switch that closes at the times when input current $I_{REF}$ corresponds to data to produce a desired response for a display element OLED in the particular column. Alternatively, one driver circuit 10 may be employed to drive plural columns in sequence, in which case switch S1 is a commutating switch that connects the display elements OLED of a particular column to driver 10 at the times when input current $I_{REF}$ corresponds to data to produce a desired response for a display element OLED in the particular column.

Transistor N1 provides a reference bias that is shared by all outputs, all positions of switch S1 in its scanning of the column lines, and its reference current $I_{ref}$ can be generated internally or externally by a user. Note that the gate of transistor N2 is connected to transistor N1 via resistor R1, and also is coupled through feedback 12 capacitor $C_{fb}$ to the output $V_o$. Specifically, capacitance $C_{fb}$ is connected between the output voltage Vo and the gate of transistor N2. The effect of the feedback 12 capacitor $C_{fb}$ is to elevate the output current $I_{OLED}$ while the column is charging. As the column settles towards its final level, the effect of the feedback 12 diminishes and goes away and the column settles at the proper current level $I_{OLED}$ which is a multiple of $I_{REF}$ determined by the multipliers of the current mirrors N1, N2 and P1, P2.

A bypass capacitor $C_{bypass}$ is used to keep the bias voltage generated by transistor N1 at a DC level, to avoid coupling between adjacent columns. Capacitance $C_{bypass}$ may be thought of as providing smoothing and noise reduction.

For discharging the column line, e.g., the capacitance thereof, an MOS transistor discharge switch (not shown) may be provided to selectively connect the column line to ground, or to a precharge voltage for the column line 20, in preparation for the next data current cycle. Further, provision may be made in the feedback path 12 for controlling what happens when the current source 14 is disconnected from the load, i.e. the column. An MOS transistor switch (not shown, connected in series with $C_{fb}$) may be utilized to open the feedback path 12 via $C_{fb}$, and another MOS transistor switch (not shown, connected in parallel with $C_{fb}$) may be utilized to discharge any residual charge on $C_{fb}$.

Figure 3:
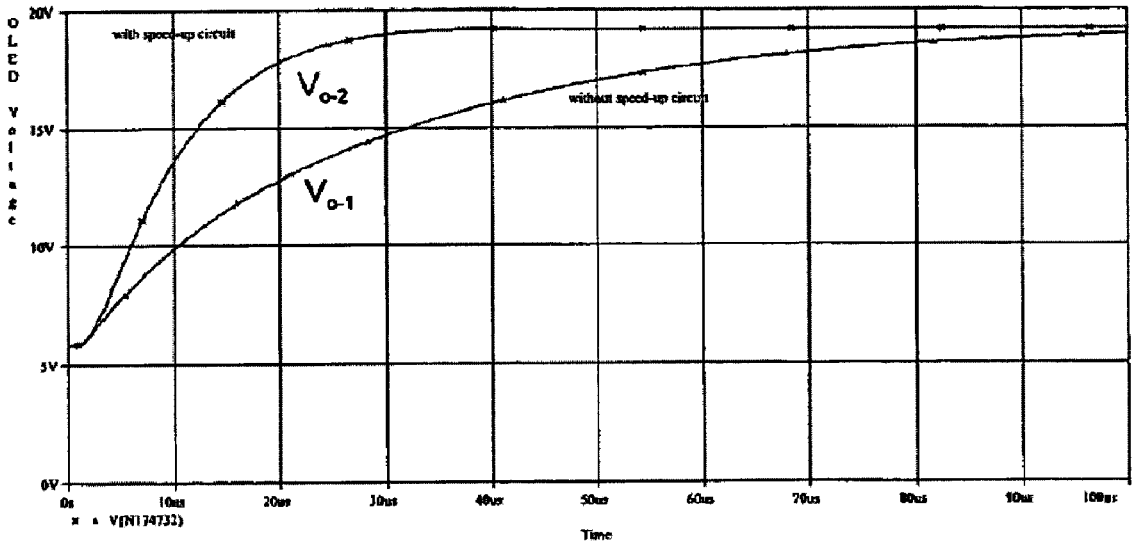
FIG. 3 is a graphical representation illustrating example voltage versus time responses for two different electronic circuits.

FIG. 3 is a graphical representation illustrating example voltage versus time responses for two different electronic circuits. Specifically, FIG. 3 illustrates charging characteristics obtained with the circuit of FIG. 2 and a typical PMOLED display column with a data current of 2 mA and a parasitic column capacitance of 5 nF, simulated with the circuit simulator PSPICE for two cases—one without feedback and another with feedback as described. FIG. 3 illustrates an example display scan line time of 100 usec, which corresponds to a 160-line display with a 60 Hz refresh rate. Because the OLED voltage $V_{o-1}$ without feedback requires substantially all of the 100 usec line time to reach its final level, the display would have serious convergence error and would not permit good gray-scale control. On the other hand, with feedback as described, the OLED voltage $V_{o-2}$ reach its final level in about 25-30% of the 100 usec line time so as to permit the speed-up circuit 10 of FIG. 2 to provide very good convergence and gray-scale control.

Transistors N2, P1, and P2 comprise a low-gain amplifier 14 with a dominant pole set by the column charging time-constant (which is actually not "constant" because of the nonlinear characteristic of the OLED diode). $C_{fb}$ introduces positive feedback 12 via a network that puts a zero into the feedback path. Significant speed-up of $V_o$ can be obtained without any stability problems, but ultimately, with a very large $C_{fb}$ and/or a large R1, the output $V_o$ can be made to overshoot and ring, and so circuit stability must be addressed in selecting appropriate element values. Making the feedback adjustable lets the user choose the optimum speed-up while avoiding instability.

The degree of speed-up provided by feedback 12 may be adjusted by changing the time-constant, i.e. the product of R1 times $C_{fb}$. The speed-up can be user-adjustable, e.g., by changing the resistance value and/or the capacitance value. For example, the capacitance $C_{fb}$ may be provided by a circuit including four to six capacitors having binary-weighted capacitance values and a like number of series switches, e.g., with one switch in series connection with each capacitance, to allow the capacitors to be switched into and/or out of parallel connection to provide a desired total capacitance $C_{fb}$.

While the circuit shown in FIG. 2 is satisfactory for many applications, it typically does not provide a very "stiff" (i.e. high output impedance) current source because the output conductance of P2 is finite. That is, the difference in drain voltage between transistors P1 and P2 could lead to current mismatch between these devices (i.e. a change or non-linearity in the current ratio or multiplier exhibited by P1, P2 as a current mirror), however, transistors P1 and P2 could be cascoded with one or more additional PMOS transistors to increase their effective output impedance.

Similarly, transistors N1, N2 may also have different drain voltages with like effect as described in relation to transistors P1, P2. Not only can these two devices N1 and N2 have different drain voltages, causing mismatched currents, but they can also be widely separated on the chip and therefore suffer from device parameter mismatch, e.g., because transistor N1 is a bias generator that will typically provide bias voltage for many output current generators (i.e. many transistors N2). This is not true of transistors P1 and P2, of which a set are provided for each column of display 20 and so transistors P1, P2 of each set can be close together and therefore will not suffer from variations in device parameters resulting from physical separation on an integrated circuit chip.

Figure 4:
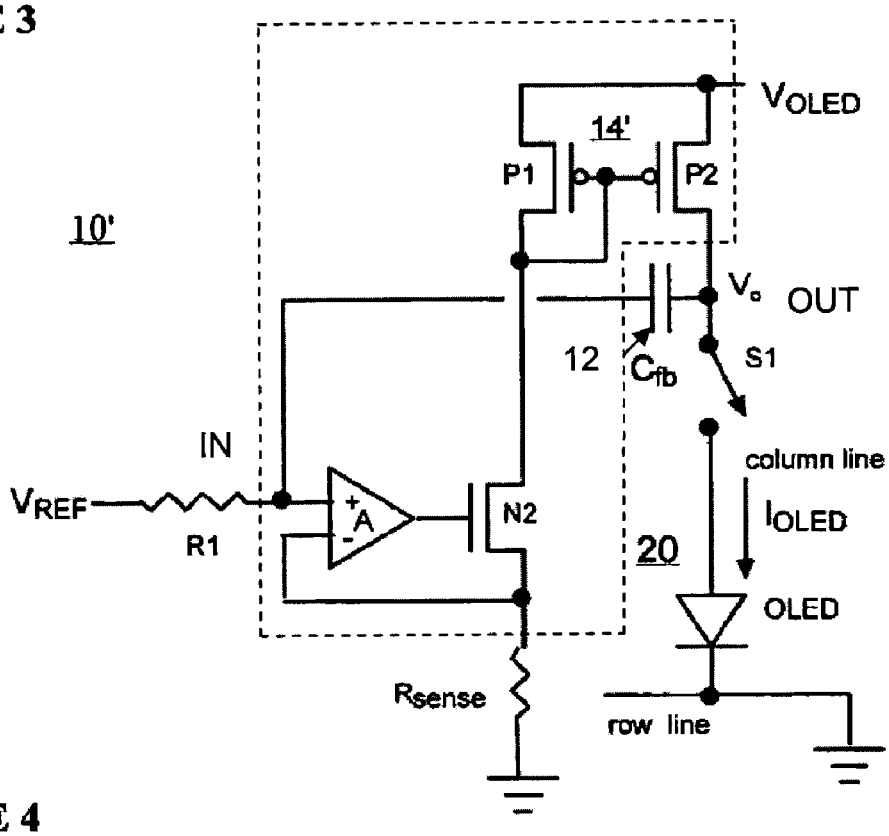
FIG. 4 is an electrical circuit schematic diagram of an example embodiment of an electronic driver circuit.

FIG. 4 is an electrical circuit schematic diagram of an example embodiment of an electronic driver circuit 10' that provides feedback 12 from the column voltage $V_o$ to the current generator 14' itself. The effects of both of the foregoing—drain voltage mismatch and parameter mismatch—are diminished or avoided in the circuit illustrated in FIG. 4.

Therein each output circuit 14' includes an operational amplifier A in addition to transistor N2. Amplifier A is arranged as a "unity follower" including transistor N2 to produce a current in transistor N2 that is directly related to the input voltage $V_{REF}$ in the steady state. Resistor $R_{sense}$ is utilized to sense the current through transistor N2 and to feedback to the input of amplifier A a signal related thereto to ensure that the voltage applied to the gate of N2 is just right for producing a DC or steady state current through N2 and P1 having the value of the ratio $V_{REF}/R_{sense}$.

Because voltage $V_{REF}$ can be externally applied, it is the same for all output circuits 14' that are connected in parallel to receive it. It is generally true in integrated circuit processes that resistances (in this case, the resistors $R_{sense}$ for each of the outputs) can be matched across a chip to greater precision than can parameters of transistors, and the matching thereof typically obtainable is typically satisfactory for matching the output currents produced by various ones of circuits 14 responsive to the drive voltage $V_{REF}$. Thus the currents through transistors P1 and P2 over all of the columns of a display 20 can be matched satisfactorily.

Feedback circuit 12 operates on circuit 14' in the same way as described above in relation to circuit 14 of FIGS. 2 and 3 with the high-pass filter R1-$C_{fb}$ providing positive feedback 12 to input of circuit 14', here at the input of operational amplifier A. Specifically, capacitance $C_{fb}$ is connected between the output voltage Vo and the non-inverting input of operational amplifier A. Thus, the current $I_{OLED}$ is dynamically increased as the column line charges more quickly towards the desired output voltage $V_o$.

One prior art approach to the column charging problem devotes part of each line time to a column-voltage precharge interval. This requires that an estimate be made of the proper starting voltage for column charging, and that the columns to be reset (pre-charged) to this voltage before switching over to the driving current sources. While this prior art approach is somewhat faster than charging each column from zero volts for each line, the reset voltage must be lower than the lowest data voltage that can turn on a pixel, and as a result the required voltage swing can still be many volts. The circuits of FIGS. 2 and 4 advantageously speed up the charging cycle itself and, for further speed-up, can be combined with a precharge interval, during which the column is reset to a voltage level that is less than the lowest data voltage.

An electronic driver circuit 10, 10' for driving a load 20, wherein the load 20 exhibits a capacitance $C_{line}$, comprises a source of an input data signal $I_{REF}$, $V_{REF}$, a controllable current source 14, 14' having an input coupled for receiving the input data signal $I_{REF}$, $V_{REF}$, for providing at output $V_o$ an output current $I_{OLED}$ proportionally related in steady-state value to the input data signal $I_{REF}$, $V_{REF}$. Capacitance $C_{fb}$ is coupled between the output of controllable current source 14, 14' and the input thereof for providing positive feedback 12 from the output to the input of controllable current source 14, 14'.

The input data signal may be a current $I_{REF}$, wherein controllable current source 14 includes diode-connected transistor N1 for providing an input voltage signal responsive to the input data signal current $I_{REF}$. The input data signal may be a voltage $V_{REF}$, wherein the controllable current source 14' includes an amplifier A coupled to a resistance $R_{sense}$ for providing a current proportional to the input data signal voltage $V_{REF}$, and the resistance $R_{sense}$. A resistance $R_1$ couples the source to the input of controllable current source 14, 14' for reacting with capacitance $C_{fb}$ for providing positive feedback 12.

Controllable current source 14, 14' may comprise a first transistor N2 of a first polarity having a controllable conduction path and a control electrode for controlling the conduction of its controllable conduction path, wherein input data signal $I_{REF}$, $V_{REF}$, is applied to the control electrode of first transistor N2. Second and third transistors P1, P2 are of a second polarity opposite to the first polarity and each of second and third transistors P1, P2 has a controllable conduction path and a control electrode for controlling the conduction of its controllable conduction path. The control electrodes of second and third transistors P1, P2 are connected to each other, to one end of the controllable conduction path of first transistor N2, and to one end of the controllable conduction path of second transistor P1, wherein the steady-state output current produced at the controllable conduction path of third transistor P2 is proportionally related to the input data signal $I_{REF}$, $V_{REF}$.

An electronic driver circuit 10 for driving a load 20, wherein the load 20 exhibits a capacitance $C_{line}$, comprises a source of an input data signal current $I_{REF}$, and a diode-connected transistor N1 of a first polarity for providing an input voltage signal responsive to the input data signal current $I_{REF}$. A second transistor N2 of the first polarity has a controllable conduction path and a control electrode for controlling the conduction of its controllable conduction path, wherein the input voltage signal provided by diode-connected transistor N1 is applied between the control electrode and one end of the controllable conduction path of second transistor N2. Third and fourth transistors P1, P2 are of a second polarity opposite to the first polarity and each of third and fourth transistors P1, P2 has a controllable conduction path and a control electrode for controlling the conduction of its controllable conduction path, wherein one end of the controllable conduction paths of third and fourth transistors P1, P2 are connected together. The control electrodes of third and fourth transistors P1, P2 are connected to each other, and to the other end of the controllable conduction path of second transistor N2. A capacitance $C_{fb}$ is coupled between the other end of the controllable conduction path of fourth transistor P2 and the control electrode of second transistor N2 for providing positive feedback 12 thereat. A resistance $R_1$ couples source $I_{REF}$ to the control electrode of second transistor N2 for reacting with capacitance $C_{fb}$ for providing positive feedback 12. The steady-state output current $I_{OLED}$ produced at the other end of the controllable conduction path of fourth transistor P2 is proportionally related to the input data signal current $I_{REF}$.

An electronic driver circuit 14' for driving a load 20, wherein the load 20 exhibits a capacitance $C_{line}$, comprises a source of an input data signal voltage $V_{REF}$, an amplifier A coupled to a first resistance $R_{sense}$ for providing a current proportional to input data signal voltage $V_{REF}$ and resistance $R_{sense}$. First and second transistors P1, P2 of a first polarity each have a controllable conduction path and a control electrode for controlling the conduction of its controllable conduction path, wherein one end of the controllable conduction paths of first and second transistors P1,P2 are connected together. The control electrodes of first and second transistors P1,P2 are connected to each other and to the other end of the controllable conduction path of first transistor P1 for receiving the current provided by amplifier A. A capacitance $C_{fb}$ is coupled between the other end of the controllable conduction path of second transistor P2 and an input of amplifier A for providing positive feedback 12 thereat. A second resistance $R_1$ couples the source to the input of amplifier A for reacting with capacitance $C_{fb}$ for providing positive feedback 12. The steady-state output current $I_{OLED}$ produced at the other end of the controllable conduction path of second transistor P2 is proportionally related to the input data signal voltage $V_{REF}$.

Electronic driver circuit 14' may further comprise a third transistor N2 of second polarity opposite to the first polarity and having a controllable conduction path and a control electrode for controlling the conduction of its controllable conduction path. The control electrode of third transistor N2 is connected to an output of amplifier A, one end of the controllable conduction path of third transistor N2 is connected to first resistance $R_{sense}$ and the other end of the controllable conduction path thereof is connected to the control electrode of first transistor P1.

As used herein, the term "about" means that dimensions, sizes, formulations, parameters, shapes and other quantities and characteristics are not and need not be exact, but may be approximate and/or larger or smaller, as desired, reflecting tolerances, conversion factors, rounding off, measurement error and the like, and other factors known to those of skill in the art. In general, a dimension, size, formulation, parameter, shape or other quantity or characteristic is "about" or "approximate" whether or not expressly stated to be such.

Further, what is stated as being "optimum" or "deemed optimum" may or not be a true optimum condition, but is the condition deemed to be "optimum" by virtue of its being selected in accordance with the decision rules and/or criteria defined by the applicable controlling function, e.g., the selected RC time constant for feedback circuit 12 may be limited by the capacitance values obtainable given the number and values of the capacitances that can be switched in parallel.

While the present invention has been described in terms of the foregoing example embodiments, variations within the scope and spirit of the present invention as defined by the claims following will be apparent to those skilled in the art. For example, circuits of opposite polarity to those illustrated may be provided where the input current mirror (illustrated with N1, N2) includes PMOS transistors and where the output current mirror (illustrated with P1, P2) includes NMOS transistors.

Amplifier A may be an operational amplifier, i.e. an amplifier having a very high forward gain, or may be another amplifier having a lesser gain. Further, amplifier A may have differential inputs as illustrated or may have only one input.

Finally, numerical values stated are typical or example values, and are not limiting values. For example, the 2 mA drive current may be a greater or lesser value, and the arrangements described may be utilized with displays having different line scan times and different numbers of lines than those set forth herein. The terms proportional and proportionally related herein include direct proportionality and/or inverse proportionality.

What is claimed is:

1. An electronic driver circuit for driving a load, comprising:

a source of an input data signal;

a controllable current source having an input coupled to the source and configured to receive the input data signal, wherein the controllable current source is further configured to provide, at an output thereof, an output current proportionally related, in steady-state value, to the input data signal; and a capacitance coupled between the output of controllable current source and the input thereof and configured to provide positive feedback from the output to the input of the controllable current source.

2. The electronic driver circuit of claim 1, wherein the input data signal is a current, and wherein the controllable current source includes a diode-connected transistor configured to provide an input voltage signal in response to the input data signal current.

3. The electronic driver circuit of claim 1 wherein the input data signal is a voltage and wherein said controllable current source includes an amplifier coupled to a resistance for providing a current proportional to the input data signal voltage and the resistance.

4. The electronic driver circuit of claim 1, further comprising a resistance coupling the source to the input of the controllable current source, wherein the resistance is configured to interact with the capacitance to provide the positive feedback.

5. The electronic driver circuit of claim 1, wherein the controllable current source comprises:

a first transistor of a first polarity having a first controllable conduction path and a first control electrode configured to control conduction of the controllable conduction path, wherein the input data signal is configured to be applied to the first control electrode; and second and third transistors of a second polarity opposite to the first polarity, wherein the second transistor has a second controllable conduction path and a second control electrode configured to control conduction of the second controllable conduction path and the third transistor has a third controllable conduction path and a third control electrode configured to control conduction of the third controllable conduction path;

wherein the second control electrode and the third control electrode are connected to one other, to one end of the first controllable conduction path, and to one end of the second controllable conduction path; and wherein the output current is configured to be produced at the third controllable conduction path, and is proportionally related to the input data signal.

6. An electronic driver circuit for driving a load, comprising:

a controllable current source having an input coupled to a source and configured to receive an input current data signal, wherein the controllable current source includes a diode-connected transistor configured to provide, at an output of the controllable current source, an output current that is proportionally related to the input current data signal; and a feedback capacitance coupled between the output of the controllable current source and the input thereof and configured to provide positive feedback from the output to the input of the controllable current source.

7. The electronic driver circuit of claim 6, wherein the feedback capacitance is coupled to a resistance.

8. The electronic driver circuit of claim 7, wherein the resistance is further coupled to a first control electrode of a first transistor and to a second control electrode of a second transistor.

9. The electronic driver circuit of claim 6, wherein the controllable current source comprises:

a first transistor of a first polarity having a first controllable conduction path and a first control electrode configured to control conduction of the first controllable conduction path, wherein the input current data signal is configured to be applied to the first control electrode;

second and third transistors of a second polarity opposite to the first polarity, wherein the second transistor has a second controllable conduction path and a second control electrode configured to control conduction of the second controllable conduction path and the third transistor has a third controllable conduction path and a third control electrode configured to control conduction of the third controllable conduction path;

wherein the second control electrode and the third control electrode are connected to one other, to one end of the first controllable conduction path, and to one end of the second controllable conduction path; and wherein the output current is configured to be produced at the third controllable conduction path and is proportionally related to the input current data signal.

10. An electronic driver circuit for driving a load, wherein the load exhibits capacitance, comprising:

a source of an input voltage data signal;

a controllable current source having an input coupled to the source for receiving the input voltage data signal wherein the controllable current source includes an amplifier for providing, at an output of the controllable current source, an output current proportionally related to the input voltage data signal and a capacitance coupled between the output of said controllable current source and the input thereof for providing positive feedback from the output to the input of said controllable current source.

11. The electronic driver circuit of claim 10 wherein said amplifier is coupled to a resistance, and further wherein the output current is proportional to the resistance.

12. The electronic driver circuit of claim 11 wherein said controllable current source further comprises:

a first transistor of a first polarity having a controllable conduction path and a control electrode for controlling conduction of said controllable conduction path, wherein the control electrode of said first transistor is connected to an amplifier output of said amplifier;

a second transistor and a third transistor of a second polarity opposite to the first polarity, wherein the second transistor has a second controllable conduction path and a second control electrode for controlling conduction of said second controllable conduction path and the third transistor has a third controllable conduction path and a third control electrode for controlling conduction of the third controllable conduction path, and further wherein a first end of the second controllable conduction path is connected to at least one end of the third controllable conduction path;

wherein the second control electrode and the third control electrode are connected to one other, to one end of the controllable conduction path of said first transistor, and to a second end of the second controllable conduction path of said second transistor; and wherein the output current is produced at the third controllable conduction path of said third transistor and is proportionally related to the input voltage data signal.

13. The electronic driver circuit of claim 10 further comprising a resistance coupling said source to the input of said controllable current source, wherein the resistance is configured to interact with said capacitance for providing said positive feedback.

14. An electronic driver circuit for driving a load, comprising:

a source of an input current data signal;

a diode-connected transistor of a first polarity configured to provide an input voltage signal in response to the input current data signal;

a first transistor of the first polarity having a controllable conduction path and a first control electrode configured to control conduction of the first controllable conduction path, wherein the input voltage signal provided by diode-connected transistor is configured to be applied between the first control electrode and one end of the controllable conduction path;

second and third transistors of a second polarity opposite to the first polarity, wherein the second transistor has a second controllable conduction path and a second control electrode configured to control conduction of the second controllable conduction path and the third transistor has a third controllable conduction path and a third control electrode configured to control conduction of the third controllable conduction path, and wherein one end of the second controllable conduction path is connected to a first end of the third controllable conduction path;

a capacitance coupled between a second end of the third controllable conduction path and the first control electrode and configured to provide positive feedback to the first control electrode; and a resistance coupling the source to the first control electrode, wherein the resistance is configured to interact with the capacitance to provide the positive feedback.

15. An apparatus, comprising:

means for driving a display element in a display; and means for providing a feedback to the driving means, wherein the feedback is proportional to a voltage to be applied at the display element, wherein an increase in the voltage to be applied at the display element is configured to cause the driving means to increase a rate at which a line capacitance of the element is charged.

16. The apparatus of claim 15, wherein the feedback providing means is configured to provide a transfer function value of zero at direct current.

17. The apparatus of claim 15, further comprising:

means for providing an adjustable value for the feedback provided by the feedback providing means.

18. The apparatus of claim 15, further comprising:

means for providing an adjustable value for the feedback provided by the feedback providing means while avoiding instability in the voltage to be applied at the display element.

19. The apparatus of claim 15, wherein the feedback is a positive feedback, and wherein the feedback providing means comprises a feedback capacitance.

20. The apparatus of claim 15, wherein the feedback providing means is configured to cause the driving means to drive one or more additional display elements.

21. A method, comprising:

driving a display element in a display; and providing a feedback to control the driving, wherein the feedback is proportional to a voltage to be applied at the display element;

wherein an increase in the voltage to be applied at the display element is configured to cause an increase in a rate at which a line capacitance of the display element is charged.

22. The method of claim 21, further comprising providing a transfer function value of zero at direct current.

23. The method of claim 21, further comprising changing the feedback in response to an adjustment in a value of a component of a feedback circuit.

24. The method of claim 21, further comprising changing the feedback in response to an adjustment in a value of a component of a feedback network while avoiding instability in the voltage to be applied at the display element.

25. The method of claim 21, wherein the feedback comprises a positive feedback.

26. The method of claim 21, further comprising driving one or more additional display elements with a high current value.

27. An apparatus, comprising:

a first circuit configured to charge a line capacitance for a display element of a display with a driving current, wherein the line capacitance for the display element is charged to an operational voltage;

a second circuit coupled to the first circuit and configured to control the driving current of the first circuit; and a feedback circuit coupled between the display element and the second circuit, wherein the feedback circuit is configured to increase the driving current in response to an increase in voltage to be applied at the display element so that the line capacitance for the display element is charged at an increased rate.

28. The apparatus of claim 27, wherein the second circuit comprises a current mirror circuit coupled to the first circuit and configured to control the driving current of the first circuit via a reference current.

29. An apparatus as claimed in claim 27, wherein said control circuit comprises an operational amplifier coupled to a transistor, wherein said operational amplifier is configured to provide a control voltage to said transistor in response to a feedback voltage provided to the operational amplifier via said feedback circuit.

30. The apparatus of claim 27, wherein the feedback circuit comprises a feedback capacitor configured to provide positive feedback to the second circuit.

31. The apparatus of claim 27, wherein the feedback circuit comprises a high-pass filter configured to have a transfer function of zero at direct current.

32. The apparatus of claim 27, wherein the feedback circuit comprises at least one of an adjustable feedback capacitance or an adjustable feedback resistance and is configured to control a rate at which the line capacitance of the display element is charged.

33. The apparatus of claim 27, wherein the first circuit comprises one or more P-type metal-oxide semiconductor (PMOS) transistors.

34. The apparatus of claim 27, wherein the first circuit comprises one or more transistors coupled in a cascode arrangement with one or more additional transistors, and wherein an effective output impedance of the first circuit is increased via the cascode arrangement.

35. The apparatus of claim 27, wherein the feedback circuit comprises a switch configured to disconnect a feedback path in the feedback circuit if the first circuit is disconnected from the display element.

36. The apparatus of claim 27, wherein the feedback circuit comprises a metal-oxide semiconductor (MOS) type switch configured to couple the feedback circuit to ground or to a precharge voltage.

37. The apparatus of claim 27, wherein the first circuit comprises a current mirror-type circuit.

38. The apparatus of claim 27, wherein the first circuit comprises a P-type current mirror-type circuit, and the second circuit comprises an N-type current mirror-type circuit having a resistance coupled between two or more transistors of the N-type current mirror-type circuit, wherein the feedback circuit comprises a capacitance coupled to the resistance, and wherein a time constant provided by the capacitance and the resistance sets a rate at which the line capacitance of the display element is configured to be charged to the operational voltage.

39. An apparatus as claimed in claim 27, wherein said charging circuit comprises a P-type current mirror type circuit, and said control circuit comprises a differential type amplifier coupled to an N-type transistor, wherein the differential type amplifier has a resistance coupled at an input thereof, and further wherein said feedback circuit comprises a capacitance coupled to the resistance, wherein a time constant provided by said capacitance and said resistance sets a rate at which the one or more display elements are charged to the operational voltage.

* * * * *

UNITED STATES PATENT AND TRADEMARK OFFICE

CERTIFICATE OF CORRECTION

PATENT NO. : 7,633,470 B2
APPLICATION NO. : 10/926521
DATED : December 15, 2009
INVENTOR(S) : Michael Gillis Kane It is certified that error appears in the above-identified patent and that said Letters Patent is hereby corrected as shown below:

Title page, item (*) Notice: should read as follows: Subject to any disclaimer, the term of this patent is extended or adjusted under 35 U.S.C. 154(b) by 1139 days.

Claim 5, Column 8, Line 50:
Delete the "," after the word "path"

Claim 14, Column 10, Line 15:
Insert the word --first-- between the words "a" and "controllable"

Claim 15, Column 10, Line 48:
Insert the word --display-- between the words "the" and "element"

Signed and Sealed this

Twenty-fourth Day of August, 2010

David J. Kappos

David J. Kappos
*Director of the United States Patent and Trademark Office*